US005937772A

United States Patent [19]

Khinkis et al.

[11] Patent Number: 5,937,772

[45] Date of Patent: Aug. 17, 1999

[54] REBURN PROCESS

[75] Inventors: Mark J. Khinkis, Morton Grove; Iosif K. Rabovitser, Skokie; Michael J. Roberts, Naperville, all of Ill.

[73] Assignee: Institute of Gas Technology, Des Plaines, Ill.

[21] Appl. No.: 08/902,137

[22] Filed: Jul. 30, 1997

[51] Int. Cl.[6] ..... F23J 3/00; F23G 5/14; F23L 7/00

[52] U.S. Cl. ..... 110/345; 110/344; 110/346; 110/347; 110/348; 110/165 A

[58] Field of Search ..... 110/346, 342, 110/345, 348, 203, 204, 205, 210, 211, 347, 165 A, 344

[56] References Cited

U.S. PATENT DOCUMENTS

| | | | |
|---|---|---|---|
| 2,750,903 | 6/1956 | Miller et al. | 110/165 A |
| 4,185,080 | 1/1980 | Rechmeier | 423/242 |
| 4,335,660 | 6/1982 | Maloney et al. | 110/206 |
| 4,779,545 | 10/1988 | Breen et al. | 110/212 |
| 4,824,441 | 4/1989 | Kindig | 44/604 |
| 4,940,405 | 7/1990 | Kelly | 431/1 |
| 5,024,169 | 6/1991 | Borowy | 110/165 A |
| 5,052,312 | 10/1991 | Rackley et al. | 110/346 |
| 5,078,064 | 1/1992 | Breen et al. | 110/212 |
| 5,205,227 | 4/1993 | Khinkis et al. | 110/345 |
| 5,282,430 | 2/1994 | Nehls, Jr. | 110/345 |
| 5,311,829 | 5/1994 | Clark et al. | 110/345 |
| 5,315,939 | 5/1994 | Rini et al. | 110/264 |
| 5,429,059 | 7/1995 | Wagoner et al. | 110/234 |
| 5,553,556 | 9/1996 | Kruger | 110/345 |

FOREIGN PATENT DOCUMENTS

| | | | |
|---|---|---|---|
| 142 437 | 5/1985 | European Pat. Off. . | |
| 748 983 | 12/1996 | European Pat. Off. . | |
| 1284851 | 7/1962 | France . | |
| 39 15 992 | 11/1989 | Germany . | |
| 52-17217 | 2/1977 | Japan | 110/342 |
| 59-157406 | 9/1984 | Japan | 110/345 |
| 764408 | 12/1956 | United Kingdom . | |

*Primary Examiner*—Ira S. Lazarus
*Assistant Examiner*—Ljiljana V. Ciric
*Attorney, Agent, or Firm*—Pauley Petersen Kinne & Fejer

[57] ABSTRACT

A process and apparatus for combustion in which a combustible material is introduced into a combustion chamber and oxidant is supplied to the combustion chamber. The combustible material is burned, and forming a primary combustion zone. A mixture of flue gases and flyash having an organic content is injected into the combustion chamber downstream of the primary combustion zone to create an oxygen-deficient reburn zone, thereby lowering the temperature of combustion, reducing the $NO_x$ content of the flue gases, and reducing the potential for $NO_x$ formation in a tertiary oxidizing combustion zone disposed downstream of the oxygen-deficient reburn zone.

17 Claims, 2 Drawing Sheets

REBURN PROCESS

BACKGROUND OF THE INVENTION

1. Field of the Invention

This invention relates to a process and apparatus for combustion of a combustible material such as coal, wood, wood waste, municipal solid waste, refuse derived fuel, sludge, biomass or other combustible material in which a mixture of recirculated flue gases and flyash with organic content is injected into a combustion chamber to provide a region of reduced oxygen availability above a primary combustion zone, and in so doing, provide an atmosphere in the combustion chamber which not only limits $NO_x$ formation in the secondary combustion zone, but also reduces $NO_x$ after it has formed.

2. Description of Prior Art

Most of the existing processes and apparatuses for combustion of combustible material such as municipal solid waste, refuse derived fuel, wood, coal, or sludge include a combustion chamber equipped with a sloped or horizontal stoker grate that reciprocates, travels, or vibrates to move the combustible material from the combustible material inlet side of the combustor to the ash removal side of the combustor. A portion of the combustion air, generally equivalent to 1.0 to 1.3 of the combustible material stoichiometric requirement, is supplied under the stoker grate. Such combustion air is typically called undergrate air and is distributed through the stoker grate to dry and burn the combustible material present on the stoker grate. The combustible material is first dried on the drying portion or drying grate of the stoker grate, then combusted on the combustion portion or combustion grate of the stoker grate. The residual material that primarily includes ash and carbon is then decarbonized or burned on the burnout portion or burnout grate of the stoker grate. The bottom ash is then removed through an ash pit. To assure carbon burnout, a high level of excess air, compared to the amount required for carbon burnout, is maintained at the burnout grate. In addition to other species, the products of combustible material drying, combustion and burnout contain products of incomplete combustion such as carbon monoxide and total hydrocarbons, oxides of nitrogen, such as NO, $NO_2$, $N_2O$ and other nitrogen-bearing compounds such as $NH_3$, HCN and the like.

There is a wide range in size for the various combustible materials in the form of solid fuels burned on stokers as well as a wide range of burning characteristics for these fuels. In the case of coal-fired stoker boilers, the coal feed is approximately sized minus 2½" to plus ⅛". Some of the coal feed is smaller than ⅛" and typically is burned in suspension and the flyash carried out of the furnace by the combustion gases.

Typical stoker boilers have one or more stages of mechanical separation for flyash. This flyash can be collected and disposed of, or injected back into the boiler to improve efficiency of fuel utilization. The collection and disposal of flyash is taught, for example, by U.S. Pat. No. 5,052,312 which discloses an apparatus and method utilizing a cyclone furnace to vitrify inorganic elements generated from the incineration of waste materials including contaminated soils into an inert vitreous slag without releasing further pollutants into the atmosphere. Also taught is the combination of a cyclone furnace with a boiler so that the cyclone furnace receives the ash from the boiler and converts the ash to a vitreous slag suitable for disposal in a conventional landfill. U.S. Pat. No. 4,185,080 teaches a method for reducing the sulfur oxide content of combustion gases resulting from combustion of sulfur-containing fossil fuels in which the sulfur-containing fossil fuels are combusted in the presence of calcium carbonate or calcium magnesium carbonate and the sulfur oxides formed by the combustion react with the calcium oxide or calcium magnesium formed from the carbonate during the combustion to form calcium sulfate or calcium magnesium sulfate. Ash formed during the combustion process is removed from the oxides by sifting. And U.S. Pat. No. 5,429,059 teaches a coal-fired firetube boiler and method for converting a gas-fired firetube boiler to a coal-fired firetube boiler in which ash is collected in a bag house from which it is dropped to an ash receptacle for subsequent disposal, and soot blowers are connected to the individual boiler tubes for removal of particulates from the boiler tubes. Finally, U.S. Pat. No. 5,311,829 teaches a process for reducing sulfur emissions and increasing particulate removal in the combustion of pulverized coal in which pulverized sulfur-containing coal is injected with combustion air into a combustion chamber and fired to create a combustion zone within the chamber, thereby forming gaseous sulfur and particulate emission products. The emission products are exhausted and the particulate emission product removed therefrom.

Flyash typically comprises a significant amount of organic content and energy lost in flyash from, for example, coal-fired stoker boilers may represent as much as 8% of the heat input to the boiler. The flyash can contain 80–85% carbon and may contain a significant amount of fuel-bound nitrogen, in which case the flyash more closely resembles the feedstock from a pulverized coal combustion boiler. Thus, to improve fuel utilization, many stoker boilers have provisions for flyash reinjection. Typically, where reinjection of flyash is utilized, the flyash from the dropout section of the boiler bank and the cyclone separators is injected back into the boiler using air. The flyash is typically sized 93% minus 20 mesh to plus 100 mesh. The problem with injection of these fines using air is that the fines bum quickly and hot, thereby generating thermal and fuel $NO_x$.

SUMMARY OF THE INVENTION

It is one object of this invention to provide a process for creating a reburn zone above the grate in a stoker boiler utilizing flyash.

It is another object of this invention to provide a process for combustion by which the heat content of flyash generated by the main combustion reaction is recovered.

It is another object of this invention to provide a process for combustion of a combustible material in which flyash is used to generate a reburn zone while minimizing the generation of thermal and fuel $NO_x$.

It is yet another object of this invention to provide a process for combustion of a combustible material comprising fuel-bound nitrogen in a stoker fired boiler which not only limits $NO_x$ formation in the combustion zone, but also reduces $NO_x$ after it has formed.

These and other objects of this invention are achieved by a process for combustion of a combustible material in accordance with one embodiment of this invention in which the combustible material, such as coal, municipal solid wastes, wood, wood waste, refuse derived fuels, biomass, sludge, other solid fuels, liquid fuels, and/or gaseous fuels are introduced into a primary combustion zone within a combustion chamber above a stoker grate. Oxidant in the form of air or oxygen-enriched air is supplied to the combustion zone for combusting the combustible material. Flue gases are mixed with flyash generated by combustion of the combustible material and injected into the combustion chamber above the primary combustion zone to create an oxygen-deficient reburn zone.

An apparatus for carrying out this process in accordance with one embodiment of this invention comprises a plurality of walls which define a combustion chamber of a stoker-type furnace having at least one grate. The grate may be a flat, sloped, reciprocated, vibrated or spreader stoker grate and may form one or a plurality of zones for processing of the combustible material. At least one ash pit is located beneath one end of the grate within the combustion chamber. Integral to the furnace and disposed downstream of the stoker grate is a boiler or other heat recovery device in which heat in the flue gases is used for generating steam or providing thermal energy for some other processes.

The apparatus further comprises at least one combustible material inlet located in at least one wall of the combustion chamber in a position such that the combustible material is introduced into the combustion chamber onto the grate. At least one conduit provides a communication with a primary combustion oxidant or undergrate oxidant source and a space beneath the grate. Primary combustion oxidant is injected into the combustion chamber from beneath the grate resulting in combusting of the combustible material to form a primary combustion zone on and immediately above the grate. Ash from the grate is deposited into the ash pit.

In accordance with one embodiment of this invention, the grate comprises a drying portion, a combustion portion, and a burnout portion. Processing of the material includes introducing the combustible material into the combustion chamber onto the drying portion, advancing it to the combustion portion, and then advancing it to the burnout portion. In this case, primary combustion oxidant is injected into the combustion chamber from beneath the grate resulting in drying of the combustible material on the drying portion, combusting of the dried combustible material which has been moved by a combustible material advancement means from said drying portion to said combustion portion, forming a primary combustion zone above the grate, and burning out any uncombusted material in the material which has been moved by the combustible material advancement means from the combustion portion to the burnout portion of the grate.

At least one of said plurality of walls defining said combustion chamber forms an opening through which a mixture of recirculated flue gases from the boiler or heat recovery section of the furnace and flyash is introduced into the combustion chamber directly above the primary combustion zone, forming a reburn zone. Oxygen concentrations within this reburn zone are maintained below a level which promotes the formation of $NO_x$. That is, the reburn zone is an oxygen-deficient reburn zone with respect to nitrogen, including nitrogen in nitrogen-bearing compounds in the zone. In this zone, nitrogen-bearing compounds from the primary combustion zone are decomposed, significantly reducing the amount of $NO_x$ in the oxygen-deficient reburn zone and reducing the potential for $NO_x$ formation in an oxidizing combustion zone above or downstream of the oxygen deficient reburn zone.

In accordance with one preferred embodiment of this invention, the mixture of flue gases and flyash is injected into the oxygen deficient reburn zone through one or more nozzles positioned in a wall of the combustion chamber such that the mixture is injected into the combustion chamber tangentially with respect to the combustion chamber walls. In accordance with yet another preferred embodiment of this invention, the mixture is injected tangentially or radially into the combustion chamber at an angle with respect to the horizontal.

In accordance with another embodiment of this invention, mounted within an opening formed in a combustion chamber wall, preferably above the grate, is a fan, blower, compressor or other type of gas moving or compressing apparatus inlet through which vitiated air from above the burnout portion of the grate is withdrawn, compressed and reinjected through a nozzle into the combustion chamber above the oxygen-deficient reburn zone, forming an oxidizing combustion zone above the reburn zone. In another embodiment of this invention, the vitiated air is mixed with fresh air or industrial grade oxygen from a nitrogen/oxygen separator and then injected into the combustion chamber. In still another embodiment, only fresh air or industrial grade oxygen is injected into the combustion chamber above the oxygen-deficient reburn zone, forming an oxidizing combustion zone.

The amount of overfire air, that is, vitiated air and/or fresh air or industrial grade oxygen, injected into the combustion chamber to form the oxidizing combustion zone above the reburn zone is an amount sufficient to provide about 2% to about 12% oxygen concentration within the oxidizing combustion zone.

BRIEF DESCRIPTION OF THE DRAWINGS

These and other objects and features of this invention will be more readily understood and appreciated from the following detailed description taken in conjunction with the drawings wherein.

DESCRIPTION OF PREFERRED EMBODIMENTS

For purposes of this invention, $NO_x$ is oxides of nitrogen or nitrogen oxides, such as NO, $NO_2$, and $N_2O$; nitrogen-bearing compounds are compounds such as HCN and $NH_3$ that can be oxidized to $NO_x$ in the presence of oxygen. The primary combustion zone is the zone in which combustion of the combustible material occurs, primarily on, and in the vicinity immediately above, the grate. The reburn zone is the volume of the combustion chamber downstream of the primary combustion zone into which products of combustion from the primary combustion zone flow. The tertiary or oxidizing combustion zone is the volume of the combustion chamber downstream of the reburn zone into which derivative flue products from the reburn zone flow. The term "combustible material" as used in this specification and in the claims means any suitable material which can be burned. However, without intending to limit its scope in any manner, "combustible material" used in the process and apparatus of this invention will typically be coal, wood waste, biomass, refuse derived fuel, sludge and/or other comparable waste. By the term "flyash" as used throughout the specification and claims, we mean fine solid particles of ashes, dust and soot produced by the burning of combustible material, being of a size which permits carrying out of the combustion chamber by the flue gases, and comprising organic components. Included within the term "flyash" as used herein is ash which has been subjected to treatment, such as grinding, to produce particles having the desired size. By the term "oxidant" as used throughout the specification and claims, we mean "air" or oxygen-enriched air. Finally, the term "oxygen-deficient" as used throughout the specification and in the claims means insufficient oxygen to promote the conversion of nitrogen-bearing compounds to $NO_x$.

Figure 1:
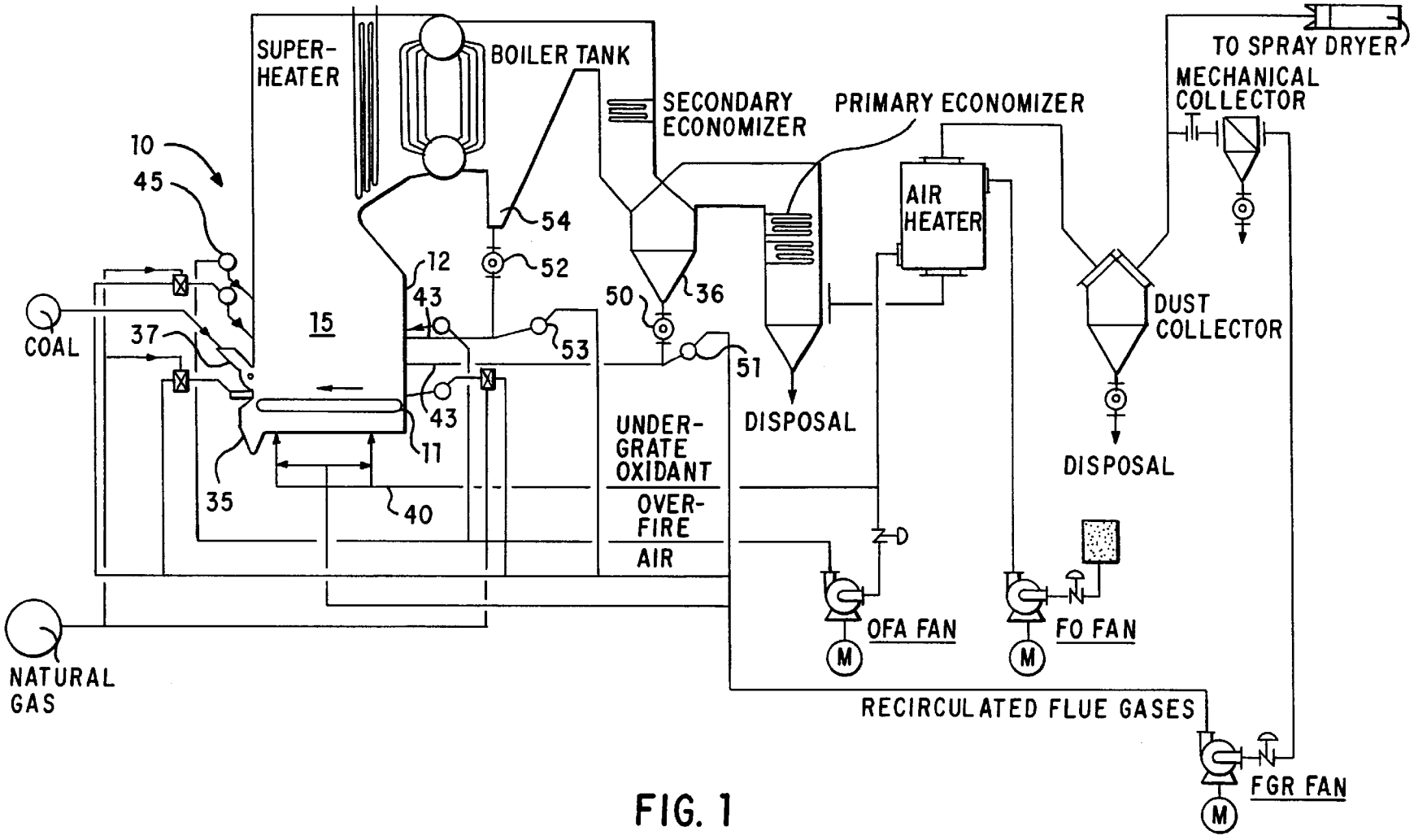
FIG. 1 shows a schematic diagram of a stoker boiler in accordance with one embodiment of this invention.
Figure 2:
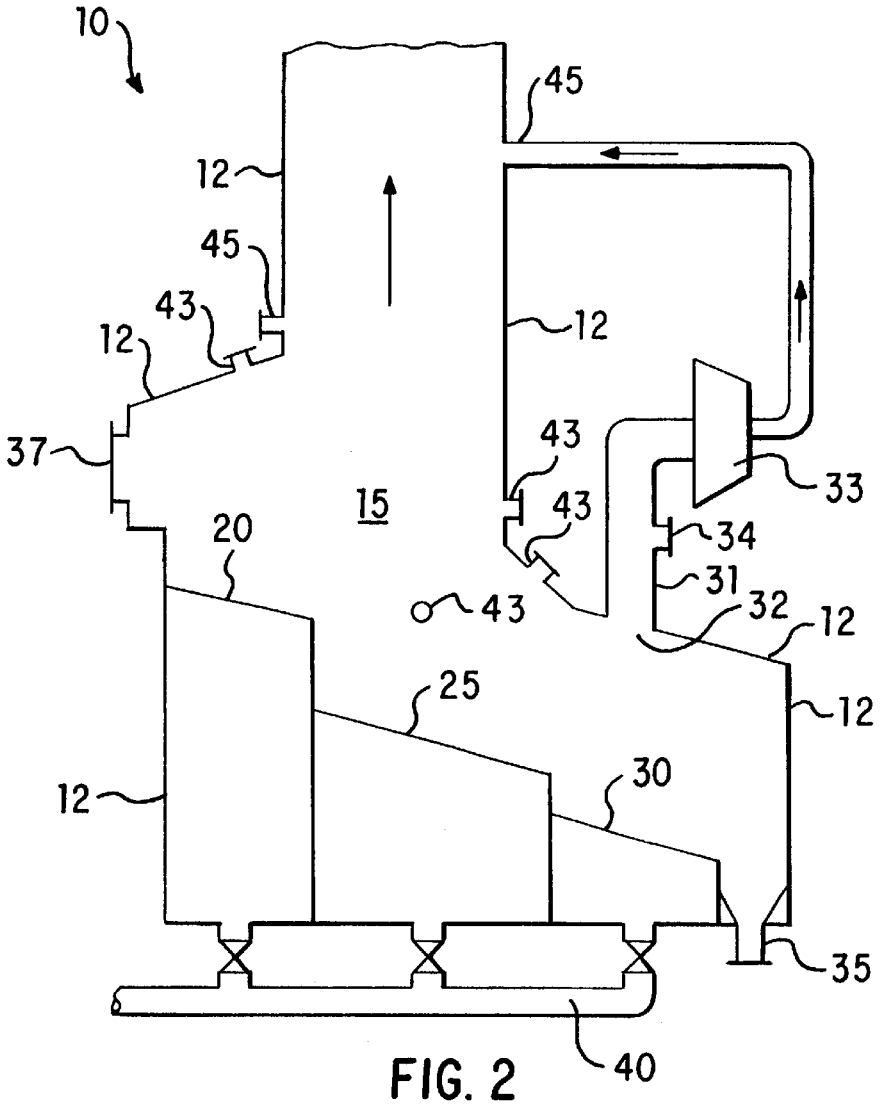
FIG. 2 shows a schematic diagram of a side view of a furnace for combustion of solid combustible material in accordance with one embodiment of this invention.

The apparatus for combustion of combustible material in accordance with one embodiment of this invention, furnace 10, is shown in FIGS. 1 and 2. A plurality of walls 12 define combustion chamber 15. A stoker grate 11 is positioned within combustion chamber 15, preferably in a lower portion thereof, and in accordance with the embodiment shown in FIG. 2 comprises at least one drying grate portion 20, at least one combustion grate portion 25, and at least one burnout grate portion 30. At least one ash pit outlet 35 is located within combustion chamber 15, positioned to receive ash from the grate 11. At least one combustible material inlet means 37 is positioned in wall 12 above stoker grate 11 such that the combustible material enters combustion chamber 15 and flows onto grate 1 1. In accordance with the embodiment shown in FIG. 2, the combustible material is advanced by combustible material advancement means from drying grate portion 20, over combustion grate portion 25, over burnout grate portion 30, and into ash pit outlet 35. In the embodiment shown in FIG. 1, the material to be processed is introduced directly onto grate 11, preferably by spreader means (not shown), where it undergoes combustion. No advancement of the combustible material is required in the embodiment shown in FIG. 2.

Undergrate oxidant supply means comprises at least one undergrate oxidant conduit 40 in communication with an undergrate oxidant source and a space beneath stoker grate 11. An undergrate oxidant source and at least one space beneath stoker grate 11 are in communication with undergrate oxidant conduit 40 and are used to provide undergrate oxidant beneath and through stoker grate 11. Undergrate oxidant is the primary source of oxidant for combustion of combustible material in combustion chamber 15. Combustion of the combustible material occurs in combustion chamber 15 primarily on, and in the vicinity immediately above, stoker grate 11, forming a primary combustion zone.

At least one recirculated flue gas/flyash injection nozzle 43 is secured to wall 12 and in communication with combustion chamber 15. Each recirculated flue gas/flyash injection nozzle is positioned on wall 12 such that a mixture of recirculated flue gas and flyash is injected into combustion products within combustion chamber 15. At least one overfire air nozzle 45 is secured to wall 12 in such a position that a fluid, preferably vitiated air, is injected into combustion chamber 15 above an oxygen-deficient reburn zone resulting from the introduction of recirculated flue gases and flyash through nozzle 43 into combustion chamber 15 above the primary combustion zone.

In accordance with one preferred embodiment of this invention, each overfire air nozzle 45 and each recirculated flue gas/flyash injection nozzle 43 is either positioned or has internal mechanical components known in the art for tangentially or radially injecting each respective fluid into combustion chamber 15, above the oxygen-deficient reburn zone and the stoker grate 11, respectively. It will be apparent to those skilled in the art that internal baffles, internal or external nozzles, or the like, can be used to tangentially or radially direct the fluid into combustion chamber 15. Thus, fluid swirl which enhances mixing can be accomplished in combustion chamber 15 having any type of cross-section, even a rectangular cross-section, as shown in FIG. 4.

Figure 3:
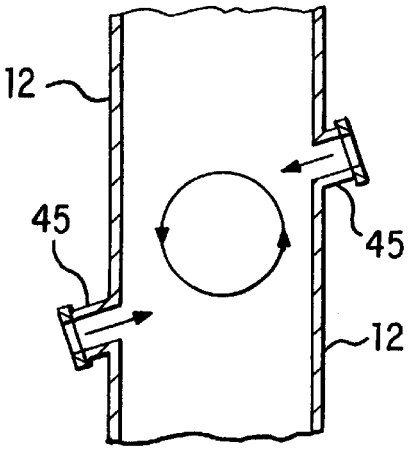
FIG. 3 shows a cross-sectional side view of an upper wall having nozzles secured at an angle with respect to the horizontal according to one embodiment of this invention.
Figure 4:
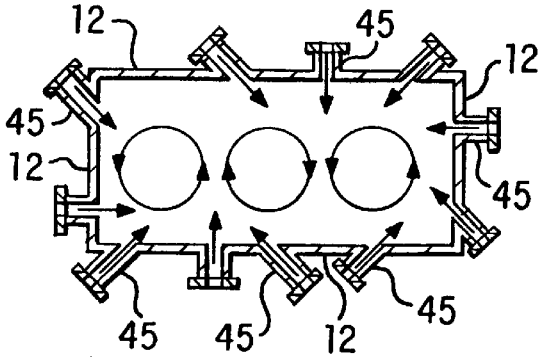
FIG. 4 shows a cross-sectional top view of the upper walls of the combustion chamber having secured nozzles that can be used to tangentially inject a fluid according to one embodiment of this invention.

As shown in FIG. 4, overfire air nozzles 45 can be positioned at angles relative to wall 12 such that at least one swirl, preferably multiple swirls, are formed within combustion chamber 15. It will also be apparent that the fluid can be injected into combustion chamber 15 at an angle with respect to the horizontal by positioning secondary air nozzle 45 at an angle with respect to the horizontal, as shown in FIG. 3.

In accordance with one embodiment of this invention, exhaust means for exhausting vitiated air from above burnout grate portion 30, as shown in FIG. 2, comprises at least one induced draft fan 33 mounted within exhaust opening 32, preferably above burnout grate portion 30. Induced draft fan 33 is utilized to exhaust vitiated air from above burnout grate portion 30, within combustion chamber 15. In accordance with another embodiment of this invention, induced draft fan 33 and a discharge nozzle are used to inject vitiated air into combustion chamber 15, downstream of the oxygen-deficient reburn zone. In accordance with a preferred embodiment, the vitiated air is mixed with fresh air or industrial grade oxygen from a nitrogen/oxygen separator (not shown) injected through air inlet means 34 into vitiated air duct 31 and then the mixture is injected into combustion chamber 15 through overfire air nozzle 45, forming an oxidizing tertiary combustion zone downstream of the oxygen-deficient reburn zone.

In a process in accordance with this invention, combustible material is introduced through combustible material inlet 37 into combustion chamber 15 and onto stoker grate 11. The combustible material is further advanced along stoker grate 11, preferably by a spreading, vibrating, or reciprocating of stoker grate 11 and by gravity. Undergrate oxidant is supplied beneath and then through grate 11 for combusting the combustible material. Ash products are removed from combustion chamber 15 through ash pit outlet 35 which is located at one end of grate 11, within combustion chamber 15.

To ensure sufficient mixing of the flyash with the combustion products from the primary combustion zone, the flyash is introduced into the combustion chamber together with a carrier fluid. The carrier fluid may be any gaseous fluid containing substantially no free oxygen. Suitable carrier fluids in accordance with this invention include flue gases, nitrogen, steam, natural gas, and products of incomplete combustion. In situations where a nitrogen/oxygen separator is utilized for providing oxygen to the combustion chamber, either in the form of oxygen-enriched air or mixed with vitiated air, the nitrogen from said separator is a preferred carrier fluid.

A mixture of recirculated flue gas and flyash having a particle size of about 93% minus 20 mesh to plus 100 mesh in accordance with one embodiment of this invention is injected through recirculated flue gas/flyash injection nozzle 43 above stoker grate 11 to form an oxygen-deficient reburn zone for decomposing nitrogen-bearing compounds, as well as reducing $NO_x$ entering the oxygen-deficient reburn zone, and improving combustible burnout downstream of the oxygen-deficient reburn zone. The flyash, which preferably contains greater than about 10% carbon or combustible material or organics and which is collected in flyash collectors 36, 54 downstream of combustion chamber 15, flows through valves 50, 52 and is entrained by flue gases flowing past valve outlets 51, 53. The flyash which is introduced into combustion chamber 15 preferably is in the range of about ⅛ inch to less than about 20 mesh in size. In addition, the recirculated flue gases preferably contain less than 10% oxygen, and more preferably less than 6% oxygen. Flue gas temperature is preferably in the range of about 200° F. to 700° F. The recirculated flue gases represent about 5% to about 30% of the flue gases at the combustion chamber exhaust.

In accordance with one preferred embodiment of this invention, vitiated air is ejected from above grate 11, mixed with fresh air or industrial grade oxygen at fresh air nozzle 34, and injected as overfire air into combustion chamber 15 above the oxygen-deficient reburn zone. The overfire air is preferably injected through at least one overfire air nozzle 45 secured to wall 12 and in communication with combustion chamber 15. Overfire air is supplied into combustion chamber 15 through at least one overfire air nozzle 45 for thorough mixing and at least partial burnout of combustibles contained within the combustible material combustion products. In accordance with a preferred embodiment of this invention, overfire air is tangentially or radially injected, with respect to wall 12, into combustion chamber 15, above the oxygen-deficient zone. In accordance with one embodiment of this invention, overfire air injected above the oxygen-deficient reburn zone provides an oxygen concentration of about 2% to about 12% in an oxidizing tertiary combustion zone.

In accordance with another preferred embodiment of this invention, the ejected vitiated air is mixed with fresh air prior to injection into combustion chamber 15 above the oxygen-deficient reburn zone. An oxygen level, relative to fuel and combustible materials, in the oxygen-deficient reburn zone in the combustion chamber is an amount equivalent to about 0.6 to about 1.3 of a stoichiometric requirement for complete combustion of the combustible materials including the flyash. Oxygen concentration downstream of overfire air nozzle 45 is about 2% to about 12%. In accordance with yet another embodiment of this invention, flue gas is recirculated and introduced into combustion chamber 15 below stoker grate 11, thereby drying and preheating combustible material on stoker grate 11. In accordance with another preferred embodiment of this invention, recirculated flue gases are mixed with the combustion air under stoker grate 11 and introduced into combustion chamber 15. The use of recirculated flue gases in accordance with this embodiment cools stoker grate 11.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A process for combustion comprising the steps of:

introducing a combustible material into a material combustion zone within a combustion chamber;

supplying oxidant to the material combustion zone, combusting the combustible material and forming a primary combustion zone;

injecting a mixture of flyash having a particle size of about 93% minus 20 mesh to plus 100 mesh and having an organic content and of at least one carrier fluid into said combustion chamber to create an oxygen-deficient reburn zone downstream of said primary combustion zone; and injecting an oxygen-containing gaseous fluid into said combustion chamber downstream of said oxygen-deficient reburn zone, forming a tertiary oxidizing combustion zone downstream of said oxygen-deficient reburning zone.

2. A process in accordance with claim 1, wherein said carrier fluid is selected from the group consisting of flue gases, steam, nitrogen, products of incomplete combustion, natural gas, and mixtures thereof.

3. A process for combustion in accordance with claim 2, wherein said carrier fluid is flue gases, said flue gases comprising less than about 10% oxygen.

4. A process for combustion in accordance with claim 3, wherein a temperature of said flue gases is in a range of about 200° F. to 700° F.

5. A process for combustion in accordance with claim 1, wherein said combustible material comprises fuel-bound nitrogen.

6. A process for combustion in accordance with claim 1, wherein said combustible material is at least one of a solid fuel, a liquid fuel, and a gaseous fuel containing fuel-bound nitrogen.

7. A process for combustion in accordance with claim 1, wherein said combustible material is selected from the group consisting of coal, wood, wood waste, refuse derived fuels, sludges, municipal solid waste, biomass, and mixtures thereof.

8. A process for combustion in accordance with claim 1, wherein said mixture of carrier fluid and flyash is tangentially injected with respect to a combustion chamber wall into said combustion chamber downstream of said primary combustion zone.

9. A process for combustion of a combustible material comprising:

introducing the combustible material into a combustion chamber and onto a stoker grate;

supplying oxidant to the stoker grate for combusting the combustible material, forming a primary combustion zone;

injecting a mixture of flyash having a particle size of about 93% minus 20 mesh to plus 100 mesh and having an organic content and of a carrier fluid above said primary combustion zone to create an oxygen-deficient reburn zone within said combustion zone; and injecting an oxygen-containing gaseous fluid into said combustion chamber downstream of said oxygen-deficient reburn zone, forming a tertiary oxidizing combustion zone downstream of said oxygen-deficient reburning zone.

10. A process for combustion in accordance with claim 9, wherein said carrier fluid is selected from the group consisting of flue gases, steam, nitrogen, products of incomplete combustion, natural gas, and mixtures thereof.

11. A process for combustion in accordance with claim 10, wherein said carrier fluid is flue gases, said flue gases comprising less than about 10% oxygen.

12. A process for combustion in accordance with claim 11, wherein a temperature of said flue gases is in a range of about 200° F. to 700° F.

13. A process for combustion in accordance with claim 10, wherein said combustible material comprises fuel-bound nitrogen.

14. A process for combustion in accordance with claim 10, wherein said combustible material is at least one of a solid fuel, a liquid fuel, and a gaseous fuel containing fuel-bound nitrogen.

15. A process for combustion in accordance with claim 10, wherein said mixture of carrier fluid and flyash is tangentially injected with respect to a combustion chamber wall into said combustion chamber above said primary combustion zone.

16. A process for combustion in accordance with claim 10, wherein said combustion material is selected from the group consisting of coal, wood, wood waste, municipal solid waste, sludge, refuse derived fuels, biomass, and mixtures thereof.

17. A process for combustion in accordance with claim 10, wherein recirculated flue gases are supplied with said oxidant to said stoker grate, said recirculated flue gases cooling said stoker grate.

* * * * *